United States Patent [19]

Kathel

[11] Patent Number: 4,578,871

[45] Date of Patent: Apr. 1, 1986

[54] INCLINOMETER

[75] Inventor: B. P. Kathel, Dehra Dun, India

[73] Assignee: Oil & Natural Gas Commission, Dehra Dun, India

[21] Appl. No.: 667,967

[22] Filed: Nov. 5, 1984

[51] Int. Cl.[4] ..... E21B 47/22

[52] U.S. Cl. ..... 33/304; 33/308; 33/311; 33/313

[58] Field of Search ..... 33/304, 308, 309, 311, 33/312, 313, 314

[56] References Cited

U.S. PATENT DOCUMENTS

| | | | |
|---|---|---|---|
| 2,103,235 | 12/1937 | Conrad | 33/313 |
| 3,789,510 | 2/1974 | Richter, Jr. et al. | 33/304 |
| 3,911,590 | 10/1975 | Litchfield et al. | 33/308 |
| 4,040,189 | 8/1977 | La Coste | 33/312 |
| 4,393,598 | 7/1983 | Powell et al. | 33/312 |
| 4,433,491 | 2/1984 | Ott et al. | 33/304 |

FOREIGN PATENT DOCUMENTS

| | | | |
|---|---|---|---|
| 553376 | 2/1958 | Canada | 33/314 |

*Primary Examiner*—Willis Little
*Attorney, Agent, or Firm*—B. K. Niyogi

[57] ABSTRACT

The inclinometer comprises a single module for measuring the inclination and azimuth of a bore, such as that of an oil well. The single module contains a removable cassette with an inclination measurement means disposed on one side thereof and an azimuth measurement means on the opposite side so as to provide a measurement recording on the substrate of the recording means. An optical assembly is provided within said module for the inclination and azimuth measurement means. Further, a power source is disposed within said module. The module has an inner and outer housing means being provided within said inner housing for providing a rotational movement thereto.

In accordance with another embodiment, the inclinometer comprises a first module being a power module for supplying power to the components of the second module. The second module has similarly an inner and outer housing, a motor for providing a rotatable movement to the inner housing, said motor connected to the power source through an optical sensor provided with the inclination measurement means. The second module has the inclination measurement means and an azimuth measurement means, each having an optical assembly. A cassette is provided within said second module. Alternatively, a memory and storage circuit is provided and, in which instance, an optical assembly is not required.

17 Claims, 8 Drawing Figures

INCLINOMETER

FIELD OF INVENTION

This invention relates to an inclinometer capable of measuring the inclination and azimuth of a bore, such as that of an oil well.

PRIOR ART

An inclinometer for measuring the inclination of a bore, such as that of an oil well, is known in the art. One such inclinometer comprises an elongate member having a fishing cap held to one end thereof and a nose assembly held to the opposite end thereof with a centre block provided therebetween. A plurality of modules are disposed between the fishing cap and centre block and, similarly, between the nose assembly and the opposite side of said centre block. The modules disposed between the fishing cap and centre block comprises a shock absorber, a battery assembly for providing power to the various other modules, a clock cell assembly for providing a timing actuation of the modules, an actuating system and a shock absorber. Thus, five modules are disposed between the fishing cap and centre block. Similarly, the modules disposed between the opposite side of the centre block and nose assembly comprises a shock absorber, commutator, inclination measuring modules consisting of a rotatable pendulum, an inclination optics assembly and a cassette module, a connector, and azimuth measuring modules consisting of azimuth cassette, and azimuth optics assembly module and a shock absorber assembly. Thus, it would be apparent that nine modules are provided between the centre block and nose assembly and, whereby, fourteen such modules are provided in said inclinometer. Accordingly, one of the distinct disadvantages of the aforesaid known construction of an inclinometer is that it consisted of fourteen such modules and, whereby, the length of the inclinometer was substantial.

OBJECT OF THE INVENTION

Accordingly, a primary object of this invention is to propose an improved construction of an inclinometer.

Another object of this invention is to propose an inclinometer capable of providing a measurement record in a digital form.

Still another object of this invention is to propose an inclinometer which does not require a surface interpretation.

A further object of this invention is to propose an inclinometer having a single angle unit in the range of 0° to 120°.

A still further object of this invention is to propose an inclinometer having a means to provide either a single shot or a plurality of shots of recordings.

Another object of this invention is to propose an inclinometer and, wherein, the accuracy is independent of drift.

Still another object of this invention is to propose an inclinometer having an illumination source for the photo optical system which reduces the time required for taking a record.

SCOPE OF THE INVENTION

According to this invention there is provided an inclinometer capable of measuring the inclination and azimuth of a bore having at least a first module consisting of an inner and outer elongate housing, said inner housing having a rotatable movement in relation to the stationary outer housing, a cassette with a recording substrate removably held within said inner housing, an inclination measuring means disposed on one side of said removably held cassette, an azimuth measuring means disposed on the opposite side of said cassette, a window provided with said cassette and such that inclination and azimuth measurements are recorded on said recording substrate.

Further according to this invention there is provided an inclinometer comprising said first module and, further, including a second module, said second module being a power module, said first module comprising an outer stationary housing and an inner rotatable housing, a motor mounted on said outer housing and coupled to the inner housing for providing a rotation thereto, an inclination measuring means having a first sensor for controlling the rotation of said rotatable inner housing, an azimuth measuring means having a second sensor and an electronic circuit being a storage and memory circuit for storing the signals received from said first and second sensors, said storage and memory circuit having output terminals therefor.

BRIEF DESCRIPTION OF THE ACCOMPANYING DRAWINGS

Further objects and advantages of this invention will be more apparent from the ensuing description when read in conjunction with the accompanying drawings and wherein.

Figure 2:
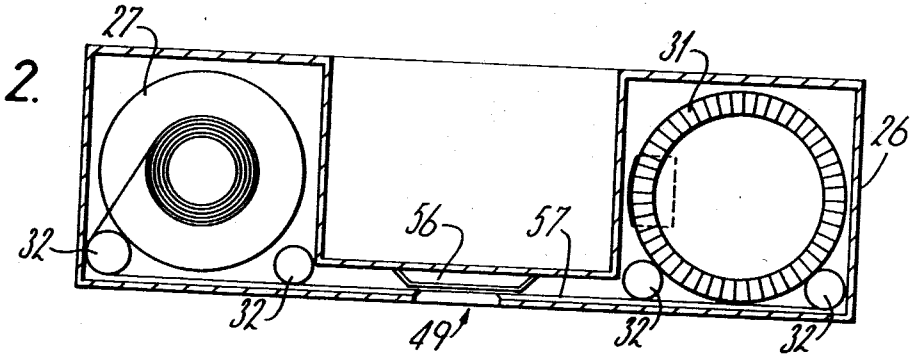
FIG. 2 shows a first embodiment of the removable recording means.
Figure 5A:
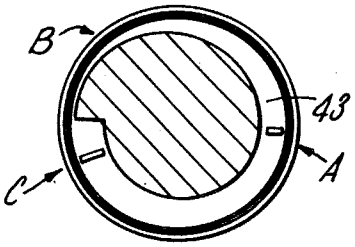
Figure 5B:
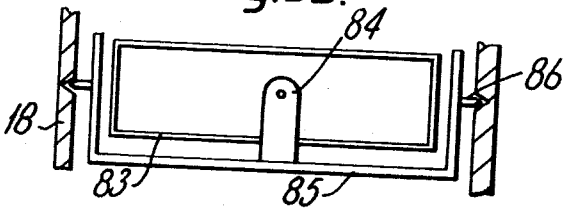
Figure 2A:
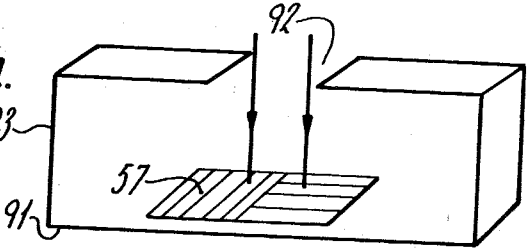
Figure 3:
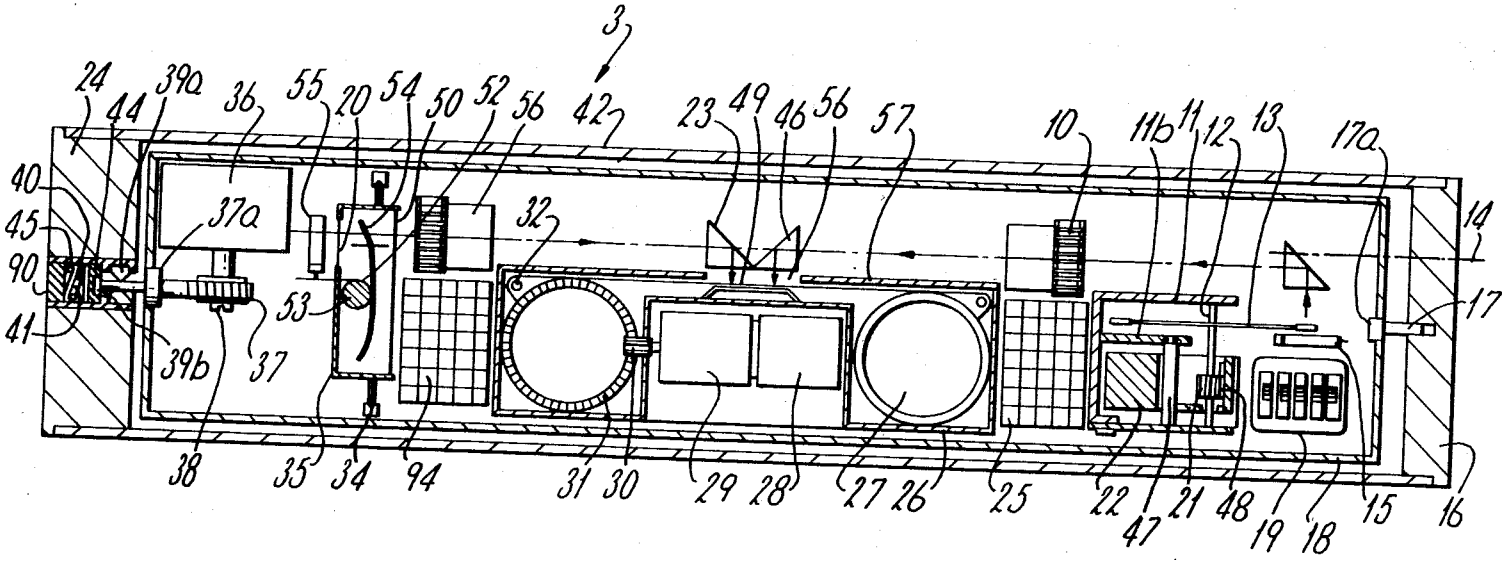
Figure 4:
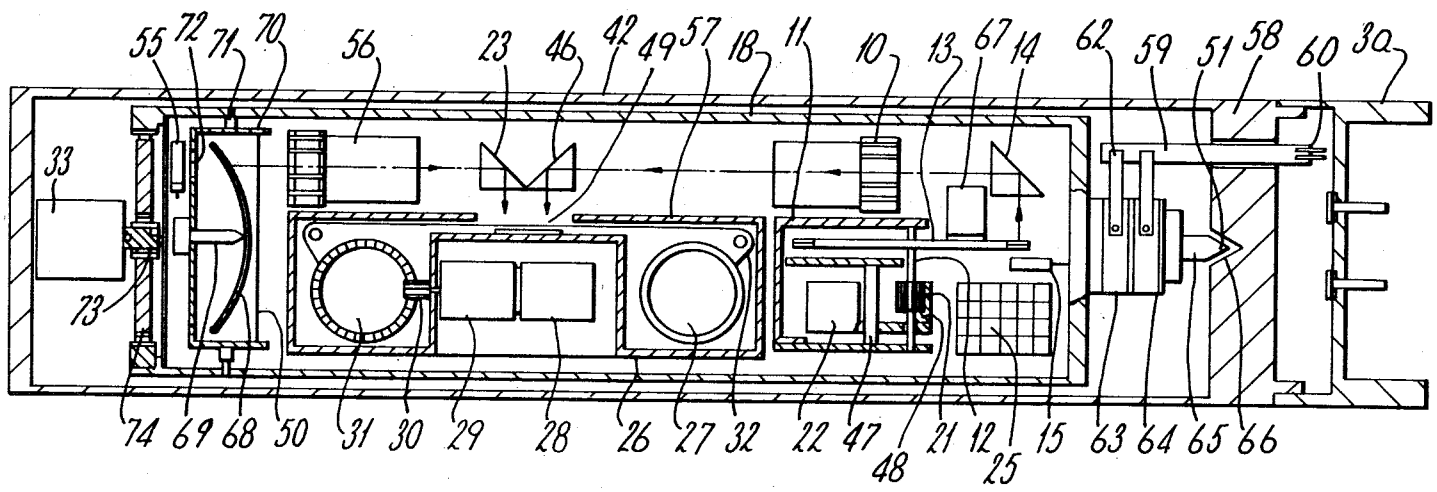
Figure 5:
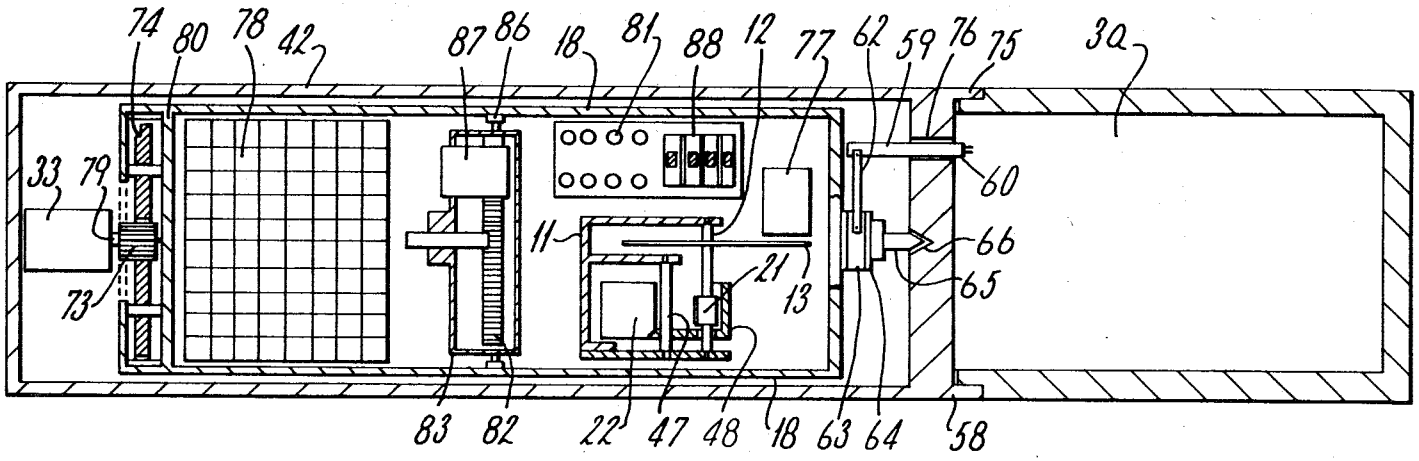

FIG. 2*a* shows another embodiment of a cassette for single shot application;

FIG. 3 shows the inclinometer in accordance with a first embodiment;

FIG. 4 shows the inclinometer in accordance with a second embodiment;

FIG. 5 shows the inclinometer in accordance with a third embodiment;

FIG. 5*a* shows the dial provided in the inclinometer of FIG. 4; and

FIG. 5*b* shows the azimuth housing of the inclinometer of FIG. 4.

Figure 1:
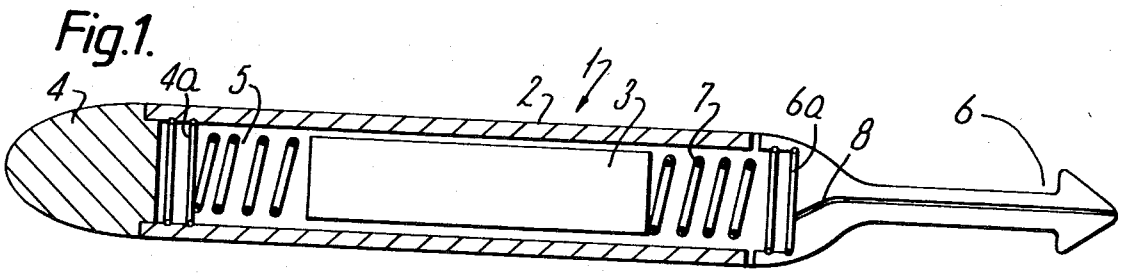
FIG. 1 shows the inclinometer of the present invention.

Reference is now made to FIG. 1 which shows the inclinometer 1 of the present invention. The inclinometer 1 comprises an outer jacket 2 which may or may not be insulated and in a manner known as such in the art. A nose 4 is held to the distal end and a fishing cap 6 is held to the proximal end of jacket 2, said nose and fishing cap being similarly provided in the inclinometers of the known art. Specifically, and in accordance with this invention, only a single rotatable measurement module 3 is provided within said jacket and, wherein, the power is provided separate to or within module 3. In the embodiment of FIG. 3, the power means is provided within module 3. In the embodiment of FIGS. 4 and 5, the power means is provided separate to module 3. In the known art, the modules occupied a length of approximately 2 feet. In the present invention module 3 has a length of approximately 6 to 8″. A spring 5 or a shock absorber is disposed between nose 4 and module 3, sealing rings 4*a* being provided therebetween. Similarly, a spring 7 is disposed between module 3 and fishing cap 6, sealing rings 6*a* provided therebetween. Fishing cap 6 has a provision to lower inclinometer 1 through a wire line 8, and as known in the art.

Reference is now made to the recording member of FIG. 2 which comprises a cassette 26 removably disposed within module 3 through a suitable opening or window (not shown) provided in jacket 2. For this purpose, module 3 has a removably mounted motor 28 coupled to a removably mounted reduction gear 29 (FIGS. 3 and 4). The output shaft of reduction gear 29 has a pinion 30 mounted thereon for imparting a drive to the drive spool 31 of cassette 26.

The cassette comprises a housing having drive spool 31 adapted to receive a drive from motor 28 through reduction gear 29 and pinion 30. Drive spool 31 has a gear in mating relationship with pinion 30. Drive spool 31 is adapted to receive a recording substrate 57, such as a film strip or recording paper, from feed spool 27. Guide rollers 32 are provided within cassette 26 for guiding the path of the recording substrate 57 from feed spool 27 to drive spool 31. Cassette 26 has a window 47 and such that the path of recording substrate 57 is across the opening formed by said window and so as to receive the graduated images. A spring plate 56 is provided within cassette 26, said plate adapted to apply a pressure on substrate 57 and in the proximity of window 49 so that substrate 57 is in a single horizontal plane when passing across window 49. Cassette 26 has a construction so as to prevent any light from entering therein except through window 49.

Cassette 26 is provided only in the inclinometer of FIGS. 3 and 4. Further, motor 28 and reduction gear 29 are removably mounted within module 3. Thus, when the inclinometer is required only for single shot application motor 28 and gear 29 is not required. Furthermore, and for a single shot application, the cassette 93 of FIG. 2*b* may be employed, which comprises a housing 91 with a window 92. The recording substrate 57 is disposed at the base of said housing. Thus, the inclinometer may be used for single or multi shot application.

Reference is now made to FIG. 3 and, wherein, the power source is provided within module 3 itself. Module 3 comprises an outer stationary tubular housing 42. An end block 24 is held to one end of outer tubular housing 42. End block 24 has a central passage 45 with a sleeve 40 disposed therein. Sleeve 40 is adapted to hold ring jewels 39*a* and thrust jewel 39*b*. One end of a shaft 37 is rotatably held within sleeve 40 through jewels 39*a* and 39*b*. Further, thrust jewel 39*b* bears against the end of said shaft, jewel 39*b* being disposed on a slidable retainer 44. Shaft 37 has a hardened round and smooth end so as to facilitate a friction less rotational movement thereof. Retainer 44 is spring loaded by means of a spring 41 held within sleeve 40 by a cover screw 90.

As it would be apparent, an inclinometer is subjected to constant jerks, when introduced within or withdrawn from the bore of a well. Thus, spring 41 functions as a dampening means to prevent the transfer to such jerks to shaft 37.

The function of shaft 37 is to displace a pendulum 22 in the direction of inclination of the bore. Such a function is effected by imparting a rotational movement to an inner housing 18, pendulum 22 being disposed within said housing. For this purpose, shaft 37 has an eccentric weight 36 held thereto, which provides a rotational movement to said shaft upon the inclinometer being displaced away from the vertical axis. Shaft 37 is held to inner housing 18 through a bush 37*a*. Eccentric weight 36 is adjustably held to shaft 37 through an adjusting screw 38 in a manner that inner housing 18 will rotate so as to bring pendulum 22 in the direction of inclination of the bore.

Reference is now made to the construction of the inclination measuring means. Pendulum 22 is rotatably held to a cup shaped housing 11 through a shaft 47 having end bearings (not shown). Pendulum 22 has a gear 48 formed on the peripheral end thereof, said gears directed inwardly and adapted to be in mating relationship with a pinion 21. Pinion 21 is mounted on a shaft 12, said shaft having a transparent dial 13 held thereto. Thus, a rotational movement of pendulum wheel 22 results in a rotational movement of shaft 12 through pinion 21. As dial 13 is held to shaft 12, a consequential rotational movement is imparted to dial 13. Accordingly, the inclination of a bore is measured through the rotational movement of inner housing 18, which disposes pendulum wheel 22 in the direction of said inclination and resulting in a rotational movement thereof, said rotational movement being transferred to dial 13 through pinion 21 and shaft 12. Dial 13 has graduations on its periphery, a light source 15 disposed below of the graduated portion of dial 13 and such as to provide illuminated images consisting of graduations, which are received by a prism 14. Light source 15 preferably comprises a zenon tube so that the time required for recordal is reduced. The images from prism 14 are transferred through an optical lens system 10 to a further prism 46 disposed in front of window 49 of cassette 26, and such that the images are transferred onto the recording substrate 57 of cassette 26. As will be apparent from FIG. 3, prism 46 is disposed in a manner such as to occupy only a part of window 49 and, whereby, the remainder of the window is available for simultaneously receiving second images from the azimuth measuring means.

Reference is now made to lens system 10, which has a first setting position for cassette 26 of FIG. 2 for multi shot applications. Lens system 10 has a second setting position for cassette 93 of FIG. 2*a* for a single shot application.

As will be apparent from the drawings, the inclination measuring means is disposed in the direction of the proximal end of inner housing 18. The proximal end of inner housing 18 is held to an end block 16 through a frictionless rotatable shaft 17 and a bearing (not shown), said shaft being held to housing 18 through a shaft head 17*a*. A space is defined between the inclination measuring means and said proximal end of inner housing 18, said space adapted to house control and programmable switches 19 therein and actuated through a window (not shown) provided in said housing. A further space is defined between cassette 26 and the inclination measuring means, an electronic circuit 25 being disposed in said space and connected to control switches 19. The electronic circuit can comprise any suitable circuit to perform a plurality of functions. The first of said functions is a programmable delay to start motor 28 and the light sources 15 and 55 to work after a programmable time. This is preferable as the inclinometer would take sometime to reach the targetted depth. The second function is to stop power supply after a programmable period after the desired number of readings are recorded. Further, the third function is to define a predetermined period between two consecutive records. The circuit comprises a control and an operational circuit. The control circuit is constantly connected to the power source and sends the command signal to the operational circuit to perform the functions according to the programme fed by the control mode switches 19.

Reference is now made to the azimuth measuring means, which comprises a cup shaped housing 35 rotatably held within rotatable inner housing 18 through shaft 34. One of the walls of housing 35 has a transparent window 20. Similarly, the front face of housing 35 comprises a transparent wall 50, a transparent liquid being disposed within housing 35 and acting as a dampening means thereto. A magnetic needle or a gyrocompass 52 is disposed within housing 35, said needle having a weight 53 for purposes of keeping the dial floating and aligned. Transparent dial 54 is held to needle 52, said dial having graduations at the peripheral end thereof. The graduated portion of dial 54 is in correspondence with window 20 so that light from a light source 55 similar to that of source 15 passes through window 20 and forms images of the graduations. Such images pass through transparent front wall 50 and through a lens system 56 similar to that of system 10, which said images are then received by a prism 23 disposed over the remainder part of slit 49. Prism 23 is provided in an opposite relationship to prism 46.

The power source 94 is disposed within module 3. For this purpose, windows (not shown) are provided for cassette, power source and switches.

Reference is now made to FIG. 4 which shows another embodiment of the inclinometer, though several constructional features of the inclinometer of FIG. 3 are also present in the inclinometer of FIG. 4 and for purpose like reference numerals are used in FIG. 4 to designate like parts of FIG. 3. The inclinometer of FIG. 4 comprises an outer stationary tubular housing 42 having an end block 58 with an opening for receiving an insulated conductor support 59. Conductor support 59 has a pair of terminal pins 60 adapted to be conducted to a power source contained within power source module 3A. A pair of conductors (not shown) are embedded within support 59, one end of the conductors being connected to its respective terminal pins 60, the opposite end being connected to its respective contact strips 62. Contact strips 62 are in light contact with rotatable rings 63 through suitable contact points, said rings held to a rotating shaft 65. Insulating washers 64 are provided between rings 63. Rotating shaft 65 has a smooth tapered end 51 supported in a main bearing 66 provided in end block 58. The opposite end of shaft 65 is held to the rotatable inner tubular housing 18.

The inclination measuring means is disposed within rotatable inner tubular housing 18, and comprises cup shaped housing 11. Pendulum wheel 22 is rotatably held to housing 11 through rotatable shaft 47. Gear 48 is provided on the end of wheel 22, said gear adapted to be in engagement with pinion 21. Pinion 21 is mounted on a rotatable shaft 12 having a transparent dial 13 held thereto. Graduations are provided at the end of dial 13, a light source 15 being disposed below said transparent calibrated portion of said dial. An optical sensor 67 is provided adjacent said dial 13. Dial 13 has a slit 43 (FIG. 5A) with a varying width and such that the quantity of light sensed by sensor 67 would be dependant on the position of slit 43 in front of light source 15. Thus, at position A, the quantity of light passing through slit 43 and sensed by sensor 67 would be more than at position B but less than position C. The width of slit 43 is in direct proportion to the graduations. Thus, sensor 67 can quantify the inclination in terms of counts through the help of electronic circuit (not shown) and in a manner as to be described subsequently herein with reference to FIG. 5.

The inclination measuring means function in a manner similar to that of FIG. 3. The angle of inclination is measured by the rotation of shaft 12, the extent of said rotation being measured by the graduations on dial 13. The light source 15 forms an image of the graduations which passes through prism 14, an optical lens system 10 and a prism 46. The images are directed by prism 46 through window 49 onto a recording substrate 57 of cassette 26. The function of sensor 67 is described subsequently herein.

A cassette similar to that of FIG. 3 is shown in the photoinclinometer of FIG. 4.

Reference is now made to the means for measuring the azimuth. Such means comprises a cup shaped housing 70 rotatably held to inner housing 18 through pins 71. A magnetic compass 68 is rotatably held to a pin 69. Azimuth housing 70 has a window 72, a light source 55 being disposed in the immediate proximity of said window. Graduations are provided at the peripheral end of magnetic compass 68 and such that light source 55 forms an image of the graduations, which pass through transparent front cover 50. Such images pass through an azimuth lens system 56 and a prism 23 so as to allow the images to be directed to the recording substrate 57. As will be apparent, prism 23 is disposed in an opposite relationship to prism 46 and in a manner as already described with reference to FIG. 3.

A rotational movement to inner tubular housing 18 is provided by motor 33 and in a manner distinct to the means for providing a rotational movement to said inner housing of FIG. 3. Motor 33 has an output shaft with a gear 73 which imparts a movement to inner housing 18 through coupling gears 74. Function of motor 33 is similar to that of the eccentric weight 36 of FIG. 3, namely, to bring the pendulum wheel 22 in the direction of the inclination of the bore. For this purpose, motor 33 is adapted to be connected to the power source provided in module 3A through sensor 67. Consider that dial 13 has a rotation but which does not provide a reading of the maximum inclination. The reading is fed into sensor 67 which allows motor 33 to be connected to the power source. The sensor 67 is in an operative mode till such time that sensor 67 has sensed the maximum inclination and, thereafter, disconnects motor 33 from the power source. In such a condition pendulum wheel 22 is then brought into the direction of maximum inclination of the bore and, whereby, light sources 15 and 55 are connected to the power source to facilitate a reading of the inclination and azimuth and, thereafter, connect motor 28 for a preset time to the power source so as to advance the substrate for a subsequent exposure. Alternatively, the encoder 77 of FIG. 5 may be employed instead of sensor 67.

The embodiment of FIG. 5 is substantially identical to that of FIG. 4 in so far as a rotation to inner housing 18 is concerned. Thus, the inclinometer of FIG. 5 similarly comprises a power supply module **3*a* held to the module 3 comprising of an outer tubular housing 42 and having an end member 58. End member 58 has a flange 75 adapted to sit within a seat provided at the end of module 3*a*. End member 58 has a passage or opening 76 through which an insulated support 59 extends, said support having terminals 60 for connecting strips 62, and of which only one is shown in FIG. 5, to the power supply. Strips 62 are in contact with rings 63 having insulating members 64 on either sides thereof. Rings 63** are held to a shaft 65, said shaft adapted to rotate within bearing 66 provided in end member 58. Shaft 65 is held to the inner housing 18. The base of outer housing 42 has a motor 33 mounted thereon and adapted to be connected to the power source in module 3*a* through distal optical encoder 77 and an electronic circuit 78. Motor 33 has a pinion 73 mounted on its output shaft 79, said output shaft having a rotational movement about partition wall 80 of the inner housing 18. Pinion 73 imparts a movement to rotatable inner housing 18 through gears 74 and in a manner as described with reference to FIG. 4.

The inclinometer has similarly a means for measuring the inclination and the azimuth, said means being disposed within inner housing 18. The means for measuring the inclination comprises a pendulum 22 rotatably held within a cup shaped housing 11 through shaft 47. Pendulum 22 has in a manner similar to FIGS. 3 and 4, an eccentrically mounted weight thereon. A gear 48 is provided on the peripheral end of pendulum 22 and in an inward direction, which meshes with a pinion 21 mounted on a spindle 12, and dial 13 being held to spindle 12. Graduations are provided at the peripheral end of dial 13, said graduations adapted to cooperate with a distal optical encoder 77. A light source is provided with the distal optical encoder 77 in order to illuminate graduactions on dial 13 which are then received by encoder 77. The sensing signal connects motor 33 to the power source through the electronic circuit 78 and such that inner housing 18 is rotated till the pendulum wheel 22 is in the inclination of the bore. The encoder 77 firstly senses the signal provided by the illuminated graduations to connect motor 33 to the power source and, thereby, allow a rotation of inner housing 18.

The function and working of encoder 77 is hereinafter described. Consider and as by way of example, motor 33 is adapted to first rotate inner housing 18 in the clockwise direction. Simultaneously, encoder 77 supplies signals to electronic circuit 78, which determines whether the number of counts is increasing. Thus, if such counts increase from 0 to +4, which is sensed and stored by electronic circuit 78, then electronic circuit 78 allows motor 33 to be connected to the power source till such time that the counts being to decrease. Consider that the maximum count is 17 corresponding to the inclination of the bore. Electronic circuit has a memory and cancellation circuit. Consider that at a particular instance the count is only 16. Thus, the previous count of 15 is still stored, and counts 15 and 16 are stored in said circuit. When the next count 17 appears, count 15 is cancelled and counts 16 and 17 are stored. As count 17 in this example is the maximum count, the next count to appear would be 16. Thus, at 16, the electronic circuit 78 disconnects motor 33 from the power source. However, as electronic circuit 78 stores two counts, the maximum count 17 is stored therein and retrieved from terminals 81. The example illustrated hereinabove, is in the instance where the count increased from 0 to 17. However, by rotating inner housing 18 from count 0 in the clockwise direction, the count could alternatively be of a decreasing order. In such an instance, the decreasing count is transferred from encoder 77 to circuit 78, and circuit 78 then supplies a signal to motor 33 so as to rotate inner housing 18 in the anti-clockwise direction till once again the maximum count is achieved in the manner as already described hereinabove. A third embodiment of an instance is where graduation on dial 13 has a reading already corresponding to the maximum inclination of the bore and, in which instance, the signal sensed by encoder 77 would be that of the maximum inclination. Consider that such a signal from encoder 77 to circuit 78 provides a count of 17. Thus, when motor 33 rotates inner housing 18 in the clockwise direction, the count decrease and, whereby, the count 17 is stored in the circuit 78 and, simultaneously, a signal is provided, whereby, motor 33 rotates inner housing 18 in the anti-clockwise direction. In such an instance, and when inner housing 18 is rotated in the anticlockwise direction, the count again decrease from count 17 and, whereby, motor 33 is disconnected from the power source. Thus, once the count is followed by a count of a decreasing value, motor 33 is immediately disconnected from the power source and the preceeding count, which is the maximum count, is stored in circuit 78 and retrieved from terminals 88.

Reference is now made to the azimuth measuring means, the azimuth measuring means comprises a housing 83 having a magnetic dial 82 rotatably disposed therein. A transparent non conducting fluid is disposed within housing 83. Magnetic dial 82 is cup shaped with graduations provided on the periphery thereof. Housing 83 is rotatably held to a ring 85 (FIG. 5*b*) through diagrammatically opposite pins 84. Ring 85 is rotatably held to inner tube 18 through diagrammatically opposite pins 86, said pins 86 being disposed at right angles to pins 85 so as to make the compass horizontal irrespective of the inclination of the tube. A distal optical encoder 87 is provided for magnetic dial 82, said encoder connected to the electronic circuit 78 for providing a reading of the azimuth. The inclinometer further has control switches 88 which is provided therefor. The working of encoder 87 is hereinafter described and, for which purpose, reference is made to the same maximum exemplary count of 17 provided by controlled circuit 38. Encoder 87 functions in a similar manner as encoder 77, namely, floating counts are continuously applied from encoder 87 to control circuit 78. However, such floating counts are continuously cancelled by the succeeding count till encoder 77 provides the maximum count of 17 and at which instance the count of encoder 87 corresponding to the period when encoder 67 had a maximum count is stored in circuit 78.

We claim:

1. An inclinometer for measuring the inclination and azimuth of a bore having only a first module comprising an inner and outer elongate housing, said inner housing having a shaft with an eccentric weight for providing a rotatable movement to the inner housing in relation to the stationary outer housing, a cassette with a recording substrate removably held within said inner housing, an inclination measuring means within said inner housing and disposed on one side of said removably held cassette, an azimuth measuring means within said inner housing and disposed on the opposite side of said cassette, an optical system for each of said inclination measuring means and azimuth measuring means, a window provided with said cassette and such that inclination and azimuth measurements are recorded on said recording substrate of said cassette.

2. An inclinometer for measuring the inclination and azimuth of a bore comprising a first and second module, said second module being a power module for supplying power to said first module, said first module comprising an inner and outer elongate housing, a motor mounted within said outer housing and coupled to one end of said inner housing for imparting a rotational movement thereto, a cassette with a recording substrate removably held within said inner housing, an inclination measuring means within said inner housing disposed on one side of said cassette, said inclination measuring means including a sensor for providing a signal to said motor, an azimuth measuring means within said inner housing and disposed on the opposite side of said cassette, an optical system for each of said inclination and azimuth measuring means, a window with said cassette and such that inclination and azimuth measurements are recorded on the recording substrate of said cassette.

3. A inclinometer for measuring the inclination and azimuth of a bore comprising a first and second module, said second module being a power source module for supplying power to said first module, said first module comprising an outer stationary housing and an inner rotatable housing, a motor mounted on said outer housing and coupled to the inner housing for providing a rotation thereto, an inclination measuring means having a first sensor for controlling the rotation of said rotatable inner housing and providing a measurement of the inclination, an azimuth measuring means having a second sensor, and an electronic circuit being a storage and memory circuit for storing the signals received from said first and second members, said storage and memory circuit having an output terminal circuit therefor.

4. An inclinometer as claimed in claim 1 wherein said outer housing has an end member at either ends thereof, the distal end member having a central passage with a sleeve disposed therein, said shaft extending within said sleeve and held thereto through bearings, said shaft being spring loaded.

5. An inclinometer as claimed in claims 2 or 3 wherein said inner housing has a shaft at the proximal end and rotatably mounted on the proximal end member of said outer housing, said proximal end member having a passage for allowing a conductor support to extend therethrough, conducting strips provided on said support and in contact with rings provided on said shaft through insulating means so as to connect the power source disposed within said second source module to said rings.

6. An inclinometer as claimed in claim 5 wherein said motor is connected to a power source through the optical sensor provided with said inclination measuring means and an electronic control circuit being a memory and storage circuit.

7. An inclinometer as claimed in claims 1, 2 or 3 wherein said inclination measuring means comprises a rotatable pendulum wheel having an eccentric weight mounted thereon, gears being provided on the periphery of said wheel and in engagement with a pinion mounted on a rotatable spindle, a transparent graduated dial held to said spindle, a light source for the graduated portion of said dial so as to form images of said graduations.

8. An inclinometer as claimed in claim 1 wherein said azimuth measuring means comprises a housing having a transparent liquid disposed therein, one side of said housing covered by a transparent wall, the opposite side of said housing having a transparent window with a light source disposed in the proximity thereof, a magnetic needle mounted within said housing for supporting a graduated dial and such that the light source forms images of the graduations provided at the periphery of said dial.

9. An inclinometer as claimed in claim 8 wherein said dial is of an arcuate shape.

10. An inclinometer as claimed in claim 2 wherein said azimuth measuring means comprises an azimuth housing with a transparent liquid disposed therein, one side of said housing having a cover of a transparent sheet, an opposite side of said housing having a transparent window with a light source disposed in the proximity thereof, a weight disposed within said housing for supporting a transparent dial with graduations provided on the periphery thereof, said dial supported on said weight through a needle, an optical means for receiving the images of the graduations and transferring said images onto the substrate of said cassette.

11. An inclinometer as claimed in claim 3 wherein said azimuth housing is rotatably disposed within said inner housing.

12. An inclinometer as claimed in claims 1 or 2 comprising a first optical means for said inclination measuring means and a second optical means for said azimuth measuring means.

13. An inclinometer as claimed in claim 12 wherein said first and second optical means include a first and second prism respectively disposed in an opposite relationship to each other, each of said prisms occupying only a part of the window of said cassette.

14. An inclinometer as claimed in claims 1 or 2 comprising a motor for driving the drive spool of said cassette, said motor having a pinion mounted on the output shaft thereof and capable of being in engagement with the teeth provided with said drive spool.

15. An inclinometer as claimed in claim 3 wherein said first and second sensors comprise each a distal optical encoder.

16. An inclinometer as claimed in claim 11 wherein said azimuth measuring means comprises a housing having a non conducting liquid therein, a magnetic dial rotatably disposed within said housing, said housing rotatably held to said inner housing.

17. An inclinometer as claimed in claim 16 wherein said housing is held to a ring through pins, said ring rotatably held to said inner housing.

* * * * *